US012768129B2

(12) United States Patent
Costello et al.

(10) Patent No.: US 12,768,129 B2
(45) Date of Patent: Oct. 20, 2026

(54) METHOD FOR IMPROVED CONTROLLING AN END-EFFECTOR OF AN EXCAVATOR

(71) Applicant: HEXAGON INNOVATION HUB GMBH, Heerbrugg (CH)

(72) Inventors: Sean Costello, Altstätten (CH); Michael Goulet Kean, Odense C (DK); Adnan Kanaan, Svendborg (DK); Pierluigi Micarelli, St. Gallen (CH); Lars Kjaergaard, Odense SV (DK)

(73) Assignee: HEXAGON INNOVATION HUB GMBH, Heerbrugg (CH)

( * ) Notice: Subject to any disclaimer, the term of this patent is extended or adjusted under 35 U.S.C. 154(b) by 356 days.

(21) Appl. No.: 18/525,556

(22) Filed: Nov. 30, 2023

(65) Prior Publication Data

US 2024/0200301 A1 Jun. 20, 2024

(30) Foreign Application Priority Data

Dec. 20, 2022 (EP) ..... 22215102

(51) Int. Cl.
*E02F 3/43* (2006.01)
*E02F 9/22* (2006.01)

(52) U.S. Cl.
CPC ..... *E02F 3/435* (2013.01); *E02F 9/2203* (2013.01)

(58) Field of Classification Search
CPC ..... E02F 3/435; E02F 1/00; E02F 3/43; E02F 3/437; E02F 9/20; E02F 9/2203;
(Continued)

(56) References Cited

U.S. PATENT DOCUMENTS

2005/0132618 A1* 6/2005 Koch ..... E02F 3/437 37/348
2009/0143896 A1* 6/2009 Janardhan ..... E02F 9/264 37/413

(Continued)

FOREIGN PATENT DOCUMENTS

CN 111104729 A 5/2020
CN 112900519 A 6/2021

(Continued)

OTHER PUBLICATIONS

Extended European Search Report dated May 30, 2023 as received in Application No. 22215102.9.

*Primary Examiner* — Alicia M. Choi
(74) *Attorney, Agent, or Firm* — Maschoff Brennan

(57) ABSTRACT

A method for controlling movement of an end-effector of an excavator, wherein the end-effector is attached to the excavator via an articulated component comprising multiple links, wherein the method comprises providing motion commands for moving the end-effector, using a motion-control algorithm to translate the motion commands to control commands for moving the multiple links with respect to each other so that the end-effector moves with a target trajectory associated with the motion commands, accessing movement sensor data configured to provide monitoring of a movement of the articulated component and the end-effector, accessing impact sensor data comprising hydraulic pressure sensing data and/or force sensor data, using the movement sensor data and the impact sensor data to determine an estimated value of an impact parameter for the articulated component.

17 Claims, 6 Drawing Sheets

(58) Field of Classification Search
CPC ..... E02F 9/2217; E02F 9/2221; E02F 9/2246; E02F 9/225; E02F 9/2253; E02F 9/2264; E02F 9/2267; E02F 9/26; E02F 9/265
See application file for complete search history.

(56) References Cited

U.S. PATENT DOCUMENTS

| | | | | |
|---|---|---|---|---|
| 2012/0216519 | A1* | 8/2012 | Peterson | E02F 9/2228 60/420 |
| 2020/0256036 | A1* | 8/2020 | Hodel | E02F 9/2253 |
| 2020/0318316 | A1* | 10/2020 | Kjaergaard | E02F 9/2037 |
| 2021/0148085 | A1* | 5/2021 | Kim | E02F 9/265 |
| 2022/0195689 | A1* | 6/2022 | Rajamani | E02F 3/3402 |
| 2023/0034265 | A1* | 2/2023 | Renner | E02F 9/264 |

FOREIGN PATENT DOCUMENTS

| | | | |
|---|---|---|---|
| EP | 0 735 202 | A1 | 10/1996 |
| EP | 3 845 714 | A1 | 7/2021 |
| JP | H10-259619 | A | 9/1998 |

* cited by examiner

METHOD FOR IMPROVED CONTROLLING AN END-EFFECTOR OF AN EXCAVATOR

FIELD

The present disclosure relates to a method and a system for controlling movement of an end-effector of an excavator, wherein the end-effector is attached to the excavator via an articulated component comprising multiple links.

BACKGROUND

Excavator control systems typically influence the velocity of the end-effector (e.g. the bucket of an excavator attached to its swing boom) using hydraulic commands (either low-pressure hydraulic pilot signals or electronic commands). Actual movement of the end-effector often deviates from a desired movement associated to these hydraulic commands because spool shifts in the excavator's main hydraulic valve, which result in pressure differences being applied to the actuators (linear cylinders and rotary motors), which in turn cause movement of the joints and the end-effector.

In other words, control commands, for example triggered by the movement of a control stick by the operator of the excavator, are processed by the excavator control system such that the subsequently used hydraulic commands provide a movement of the end-effector (bucket) along a target trajectory predefined by the movement of the control stick.

While this movement along the target trajectory (i.e., the dependence/association of the end-effector's movement on the control commands) is predictable to some degree in the air or when grading loose material, this is less so when actually digging in the ground. This is because ground resistance has an important influence on the end-effector force (i.e. the force acting on the contact point of the end-effector with the ground), which increases abruptly when the end-effector hits a material with high resistance and thus (if not readjusted in time with adapted control commands) the end-effector velocity is abruptly reduced.

Such an increase of the end-effector force without adjusting the movement of the end-effector in time, for example by adjusting the cylinder pressures, can lead to damage of the end-effector, the excavator arm or in the worst case to damage of the entire excavator. An abrupt slowdown of the end-effector can be conducted through the entire excavator as a kind of shock wave and thus affect the operator in his work. Furthermore, the increase of the end-effector force without timely adjustment of the movement of the end-effector can lead to the end-effector being deflected from its target trajectory given by the control commands and thus the desired design surface is not obtained.

Consequently, there is a need for methods and systems that enable to precisely control the end-effector so that it moves along the target trajectory during digging to avoid a two-step workflow of coarse and subsequent fine excavation, to adapt the control commands (and thus the hydraulic commands) as quickly as possible to avoid shocks and damage during excavation, and to adapt the end-effector trajectory as quickly as possible in response to changes in the end-effector force (e.g. by reducing speed, digging depth, or changing bucket angle) to dig efficiently (which could save fuel, make the work time- and resource-efficient, i.e. with as few work steps and corrective measures as possible, and protect the excavator parts, thus requiring fewer replacement of wear parts, which in turn leads to less waste).

Further, it is desired that the mentioned operations are initiated and run as automatically as possible and without further actions/input of the operator, in order to relieve the operator of a stressful, error-prone and recurring reaction to conditions at the excavation site (e.g., different dig materials, which the operator partly cannot see when the end-effector is below ground, etc.) and thus to facilitate the operator's daily work.

SUMMARY

It is therefore an object of the disclosure to provide a method, a system and a computer program product for controlling movement of an end-effector of an excavator, by means of which the disadvantages of the prior art can be overcome.

Another object of the disclosure is to provide a method, a system and a computer program product for providing a partially automated and more efficient excavation (digging) workflow.

The present disclosure relates to a method for controlling movement of an end-effector of an excavator, wherein the end-effector is attached to the excavator via an articulated component comprising multiple links, wherein the method comprises

- providing motion commands for moving the end-effector,
- using a motion-control algorithm to translate the motion commands to control commands for moving the multiple links with respect to each other so that the end-effector moves with a target trajectory associated with the motion commands, in particular by taking into account hydraulic response to resistance against the articulated component, more particularly by taking into account spool shift in a hydraulic valve,
- accessing movement sensor data configured to provide monitoring of a movement of the articulated component and the end-effector,
- accessing impact sensor data comprising hydraulic pressure sensing data, which provide information on pressure applied to a hydraulic unit being configured to provide movement of the articulated component and/or the end-effector, and/or force sensor data, which provide a force and/or moment measured at one of the multiple links and/or at the end-effector,
- using the movement sensor data and the impact sensor data to determine an estimated value of an impact parameter for the articulated component, wherein the impact parameter provides information on an end-effector force exerted by a contact-component of the end-effector specifically foreseen for interaction with material to be moved by the end-effector (e.g. a 2D or 3D end-effector force vector) and/or an information on a load exerted on one of the multiple links (e.g. a torque vector), and
- providing adapted control commands by using a movement model for the articulated component configured to provide coordination of control commands of the multiple links as a function of the estimated value of the impact parameter.

In other words, hydraulic pressure sensors measure the cylinder pressures (impact sensor data comprising hydraulic pressure sensing data), wherein at least the boom extend cylinder pressure is measured, and potentially others. Alternatively, a force sensor (e.g. a load cell) is mounted at the end effector, e.g. between the bucket and the arm (providing force sensor data). Further, a kinematic sensing system (e.g. based on IMUs, rotary encoders, linear encoders, a vision system, etc.) measures the joint angles, rates and accelerations (as movement sensor data).

Then, for example, an end-effector force estimation algorithm uses both the kinematic measurements (movement sensor data) and the pressure measurements (impact sensor data) to estimate an impact parameter as an end-effector force vector. This is at least a 2-D linear force vector (horizontally in the direction of digging, and vertically), but might also be a 3-D linear force vector (information on the end-effector force) or even also a rotational torque vector (information on the load).

The end-effector force estimation algorithm may be either rely on, for example, a physics-based first-principles model (e.g. using moments of inertia, friction, etc.) or, for example, a data-driven model obtained using training data gathered from the machine (excavator) under various operating conditions (e.g. performing different motions in the air with weights in the bucket).

In a next exemplary step, a motion-control system uses the estimated value of the impact parameter, wherein the impact parameter in this example provides information on an estimated end effector force, in order to:

help follow a desired end-effector trajectory, by computing the valve commands dependent on the (estimated) end-effector force (providing adapted control commands by using a movement model) to ensure the end effector is not deflected from the desired trajectory (e.g. if the ground force is pushing upwards, the valve commands that compensate for this with increased downwards force can be computed), and/or adapt the end-effector trajectory (e.g. by reducing the end-effector velocity/speed, or the digging depth or by variation of the bucket angle) in response to the (estimated) end-effector force (coordination of control commands of the multiple links as a function of the estimated value of the impact parameter) (e.g. if the ground resistance is known, the speed can be limited to ensure the excavator's power limit is not exceeded).

There are multiple exemplary options for how such a force feedback (estimated end-effector force) can be used by the motion-control system. The bucket force could be used by either (or both) a kinematic motion-control or a low-level joint control. For example, the low-level hydraulic joint controller could use a previously-identified model (movement model) that relates valve commands, end-effector (or cylinder) forces and joint velocities.

In other words, the disclosure proposes to remedy the prior art performance problems by using an estimate of the impact parameter (e.g. end-effector force) as input to the motion-control algorithm.

In one embodiment of the method, the providing of the adapted control commands comprises evaluating the estimated value of the impact parameter with respect to a material interaction criterion, wherein the material interaction criterion provides a defined interaction mode of the contact-component with the material to be moved (also called dig material), wherein the defined interaction mode provides a boundary on allowed values of the impact parameter, particularly wherein the evaluating comprises selecting the material interaction criterion from at least two different material interaction criterions which define different boundaries on the allowed values of the impact parameter.

In a further embodiment, the articulated component is configured as an excavator arm, the multiple links are configured as a boom, a stick (arm), and particularly a tilt-rotor, the hydraulic valve and/or the hydraulic unit is configured as a cylinder, and/or the contact-component of the end-effector is configured as a blade, a tooth, and/or a back of a bucket, particularly wherein the end-effector is configured as a bucket, more particularly, wherein the multiple links are movably connected to each other and/or the end effector is movably connected to at least one of the multiple links by means of joints.

In a further embodiment, the movement model is configured to provide a relationship between valve commands, determined cylinder forces, and determined joint velocities to estimate their impact on the end-effector force and/or the load.

In a further embodiment, the estimated value of the impact parameter for the articulated component, the end-effector force, and/or the load is provided to an operator of the excavator by means of a haptic and/or visual and/or acoustic feedback signal.

In a further embodiment, the method comprises generating a history of data providing comparison information between the hydraulic pressure sensing data being obtained from the hydraulic unit and/or providing comparison information between the force sensor data being obtained from the end-effector performing motions in air and material, wherein the movement model is configured to be trained using a learning algorithm, in particular using supervised learning, using the history of data, in particular wherein the movement model is configured to be trained in a simulation environment.

In other words, the motion-control algorithm can directly use the cylinder pressure measurements (hydraulic pressure sensing data) and/or force/moment measurement (force sensor data) as input. Such a controller might be an AI controller, trained using supervised learning using timeseries data (history of data) obtained from an excavator performing a variety of motions in air and material. Alternatively it could be trained via reinforcement learning in a simulation environment.

In a further embodiment, the method comprises training the motion-control algorithm by reinforcement learning such that the motion-control algorithm learns to translate the motion commands to the control commands for moving the multiple links with respect to each other so that the end-effector moves with the target trajectory, and/or to provide the material interaction criterion dependent on the end-effector force.

In a further embodiment, the material interaction criterion is selected from a set of switchable material interaction criterions defining different interaction modes, wherein the switching between the material interaction criterions is performed by manual input of the operator.

In a further embodiment, the material interaction criterion is selected from the set of switchable material interaction criterions defining different interaction modes, wherein the switching between the material interaction criterions is performed automatically based on a design surface, in particular wherein the design surface is derived from previous target trajectories, and/or a history of previous end-effector forces and/or loads, wherein from the previous end-effector forces and/or loads a (dig) material property is derived and assigned to an interaction mode, wherein based on the assignment of the (dig) material property to an interaction mode the associated material interaction criterion is selected.

In a further embodiment, the movement sensor data and/or impact sensor data are accessed during at least one of digging, pulling the end-effector, in particular the contact-component, over the ground, lifting the end-effector filled with (dig) material, moving the end-effector through the air, pressing with the end-effector, in particular with the contact-component, on the ground.

In a further embodiment, the material interaction criterion is configured to take into account a desired ground resistance, particularly wherein the material interaction criterion ensures that the coordination of control commands is provided to ensure an end-effector force that provides a ground resistance below the desired ground resistance.

In a further embodiment, selection of the material interaction criterion takes into account a desired digging depth, particularly wherein the material interaction criterion is selected from the set of switchable material interaction criterions by selecting a defined interaction mode as soon as the desired digging depth is reached based on the end-effector force and/or the load.

In a further embodiment, the material interaction criterion provides selection between different interaction modes as a function of variations in the dig material, in particular variations in density and/or cohesion, in particular wherein the variations in the dig material are used to classify the dig material, wherein the defined interaction mode is carried out dependent on the dig material.

In a further embodiment, the material interaction criterion provides setting of an angle between the contact-component and the dig material as a function of the end-effector force, wherein the interaction mode associated with the material interaction criterion provides setting of the contact-component in such a way that a defined constant angle exists between the contact-component and the dig material, in particular wherein at this defined constant angle the end-effector force and/or the load is minimal for a given end-effector velocity.

In a further embodiment, the material interaction criterion takes into account filling levels and/or weight levels of the end-effector depending on the dig material, wherein as soon as the filling level and/or weight level of the end-effector has reached a predefined value, particularly between 80% and 140%, a filling level and/or weight level notification is provided to the operator of the excavator, and/or adapted control commands are provided by using the movement model in order to exit the end-effector from the ground and/or release the dig material from the end-effector.

In a further embodiment, the filling level of the end-effector, and/or the dig material are further provided by optical sensing unit data, in particular camera data, wherein the filling level of the end-effector and/or the dig material provided by the optical sensing unit data is matched with the filling level of the end-effector comprised by the material interaction criterion, wherein a more accurate determination of the filling level of the end-effector is achieved.

In a further embodiment, the material interaction criterion controls the impingement of the end-effector on and/or the lifting of the end-effector from the material to be moved by the end-effector, wherein the defined interaction mode is carried out in such a way that an abrupt movement of the excavator and/or the articulated component and/or the end-effector is prevented.

In a further embodiment, as soon as the end-effector force and/or the load indicates that the end-effector encounters a particularly resistant dig material, in particular a rock, the material interaction criterion provides a defined interaction mode to be carried out in such a way that the particularly resistant dig material is circumvented.

In a further embodiment, the material interaction criterion provides control of a vertical force with which the contact-component of the end-effector, in particular with the back of the bucket, presses on the material to be moved, wherein the defined interaction mode is carried out in such a way that the vertical force is constant while the end-effector, in particular the back of the bucket, is moved over the material to be moved.

In a further embodiment, the defined interaction mode is carried out in such a way that the vertical force reaches a value corresponding to a predefined tilt angle of an excavator base, and/or a lifting of the excavator from the ground and an associated reduction of the contact surface of moving means of the excavator, wherein a reduction of the interaction of the moving means with the ground during a rotation of the moving means is achievable by means of the reduction of the contact surface.

The present disclosure further relates to a system for controlling an excavation operation by an end effector of an excavator to obtain a design surface, wherein the system is configured to carry out the method (described above) of one of claims 1 to 11, for which it comprises a computing unit configured to receive the motion commands of the step of providing motion commands according to claim 1, to use the motion-control algorithm of the step of using the motion-control algorithm to translate the motion commands to control commands according to claim 1, particularly wherein the motion-control algorithm is stored on the computing unit, to access movement sensor data of the step of accessing movement sensor data according to claim 1, to access impact sensor data of the step of accessing impact sensor data according to claim 1, to use the movement sensor data and the impact sensor data of the step of using the movement sensor data and the impact sensor data to determine an estimated value of an impact parameter for the articulated component according to claim 1, and to provide adapted control commands of the step of providing adapted control commands by using a movement model for the articulated component according to claim 1, particularly wherein the movement model is stored on the computing unit.

In one embodiment of the system, the system comprises a sensor unit configured to be mounted on an excavator and—in a state mounted to the excavator—to provide the movement sensor data, in particular wherein the sensor unit is configured as a pressure sensor determining pressure data of the cylinder.

In a further embodiment, the system comprises a camera configured to generate camera data providing a view from the excavator onto the end-effector and/or the articulated component.

In a further embodiment, the system comprises a display unit, particularly touch display, providing display, particularly display of the end-effector force, and/or selection of material interaction criterions.

The present disclosure further relates to a computer program product comprising program code which is stored on a machine-readable medium, or being embodied by an electromagnetic wave comprising a program code segment, and has computer-executable instructions for performing, in particular when run on a computing unit of a system (described above) according to one of claims 12 to 13:

accessing the motion commands of the step of providing motion commands according to claim 1, using the motion-control algorithm of the step of using the motion-control algorithm to translate the motion commands to control commands according to claim 1, accessing movement sensor data of the step of accessing movement sensor data according to claim 1, accessing impact sensor data of the step of accessing impact sensor data according to claim 1, using the movement sensor data and the impact sensor data of the step of using the movement sensor data and the impact sensor data to determine an estimated value of an impact parameter for the articulated component according to claim 1, and providing adapted control commands of the step of providing adapted control commands by using a movement model for the articulated component according to claim 1.

In one embodiment of the computer program product, the program code comprises computer-executable instructions for performing any step in the method according to one of claims 2 to 11.

The method, the system and the computer program product have the advantage over the prior art that, among other things, based on the estimated impact parameter (e.g. end-effector force), the respective control and thus the respective movement of the components of the articulated component or the bucket is automatically adjusted (without the operator having to actively adjust his motion commands himself/partially automated workflow), precise control of the end-effector of the excavator is enabled even in the case of rapid changes from soft to hard dig material, thus preventing shocks to the excavator/operator (increased efficiency in digging and increased comfort in controlling the excavator), the end-effector is prevented from stalling even when the ground is very compact or when the end-effector hits a particularly hard object such as a stone (increased efficiency when digging and increased comfort when controlling the excavator), a partially automated and more efficient excavation (digging) workflow (for example, by adjusting the bucket angle) is provided, a precise following of a target trajectory (in order to obtain the desired design surface) is enabled even in case of changes in the dig material (by adapted control commands) (thus, for example, it is not necessary to first perform a rough excavation and then in a second step perform a fine excavation to the design surface), and finding the right/desired digging depth and bucket angle to dig efficiently is simplified.

BRIEF DESCRIPTION OF THE DRAWINGS

Aspects are illustrated in more detail below, purely by way of example, with reference to working examples shown schematically in the drawing. Identical elements are labelled with the same reference numerals in the figures. The described embodiments are generally not shown true to scale and they are also not to be interpreted as limiting.

DETAILED DESCRIPTION

Figure 1:
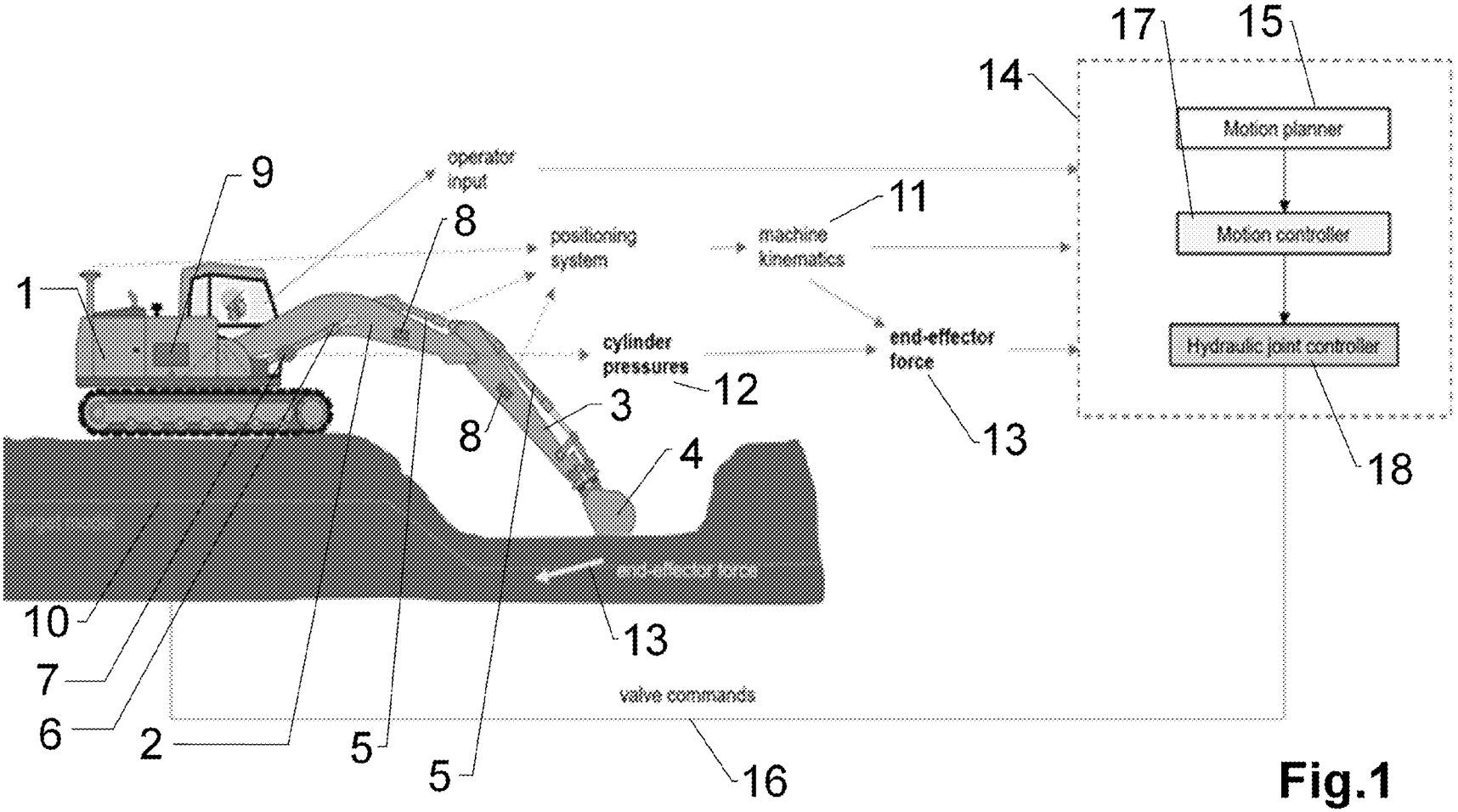
FIG. 1: schematic illustration of the system during a digging operation.

FIG. 1 shows a schematic illustration of the system carrying out the method during a digging operation. The system comprises in this example the excavator 1, which has an articulated component consisting of a (swing) boom 2 and an arm/stick 3, wherein a bucket 4 is attached to the arm 3. Boom 2, arm 3 and the bucket 4 (end-effector) are movably connected to each other via joints, wherein the movement of these parts around the joints is controlled by extension and retraction movements of the cylinders 5,6.

The system also comprises hydraulic pressure sensors 7 that measure the cylinder pressures 12 (the system can also comprise, for example, force sensors, which provide a force and/or moment measured at one of the multiple links and/or at the end-effector), wherein at least the boom extend cylinder 6 pressure is measured (on each cylinder for controlling components of the articulated component, e.g. excavator boom 2/arm 3, and the bucket 4, a corresponding hydraulic pressure sensor 7 can optionally be mounted, which measures the cylinder pressures 12 of the respective cylinders), a positioning (kinematic sensing) system 8 (e.g. based on IMUs, rotary encoders, linear encoders, a vision system, etc.) measuring, as machine kinematics, for example the joint angles, rates and accelerations used to monitor the movement of the boom 2, the arm 3 and the end effector 4, and a computing unit 9.

For example, the computing unit 9 receives motion commands to move the end effector 4 by the operator moving a control stick, and then uses a motion control algorithm, wherein the motion-control algorithm is stored on the computing unit 9, to translate the motion commands to control commands for moving the boom 2, arm 3 und the end-effector 4 with respect to each other so that the end-effector 4 moves with the target model 10 (target trajectory) associated with the motion commands.

Subsequently, the computing unit 9 accesses the movement sensor data (machine kinematics 11) acquired by the positioning system 8 and the impact sensor data comprising the cylinder pressures 12 (hydraulic pressure acquisition data) and uses the movement sensor data 11 and the impact sensor data 12 (e.g., by means of an end-effector force estimation algorithm) to determine an estimated value of an impact parameter. In this example, the impact parameter 13 provides information on an estimated end-effector force 13 exerted by the teeth of the bucket 4.

In a further exemplary step, the computing unit 9 uses a motion control system 14, which in turn uses the estimated value of the end-effector force 13, in order to help the system to follow the desired end-effector trajectory 10 (provided by a motion planner 15) by computing the valve commands 16 dependent on the estimated end-effector force 13 (providing adapted control commands by using a movement model, wherein the movement model is stored on the computing unit 9) to ensure the end effector 4 is not deflected from the desired trajectory 10 (e.g. if the ground force is pushing upwards, the valve commands 16 can be computed to compensate this with increased downwards force), and adapts the end-effector trajectory 10 (e.g. by reducing the speed, or the digging depth) in response to the estimated end-effector force 13 (coordination of control commands of the boom 2, arm 3 und the end-effector 4 as a function of the estimated value of the impact parameter 13) (e.g. if the ground resistance is known, the speed can be limited to ensure that the excavator's power limit is not exceeded).

In this example, the estimated end-effector force 13 is used by the (kinematic) motion-controller 17 and the hydraulic joint controller 18, both comprised by the motion-control system 14. The hydraulic joint controller 18 uses the movement model that relates valve commands 16, end-effector forces, cylinder forces and/or joint velocities.

Even though the exemplary embodiment of the system described in FIG. 1 only accesses impact sensor data 12, which comprises hydraulic pressure sensing data as cylinder pressures, it is clear to the skilled person that this system can also be implemented with corresponding force sensor data, which provide a force and/or moment measured at one of the multiple links 2,3 and/or at the end effector 4, (or a combination of hydraulic pressure sensing data and force sensor data as impact sensor data 12). It is also clear to the skilled person where to place the corresponding force sensors (e.g. load cells) (e.g. at the end effector/between the bucket 4 and the arm 3) and how to adapt, for example, the end-effector force estimation algorithm for processing the force sensor data.

Figure 2:
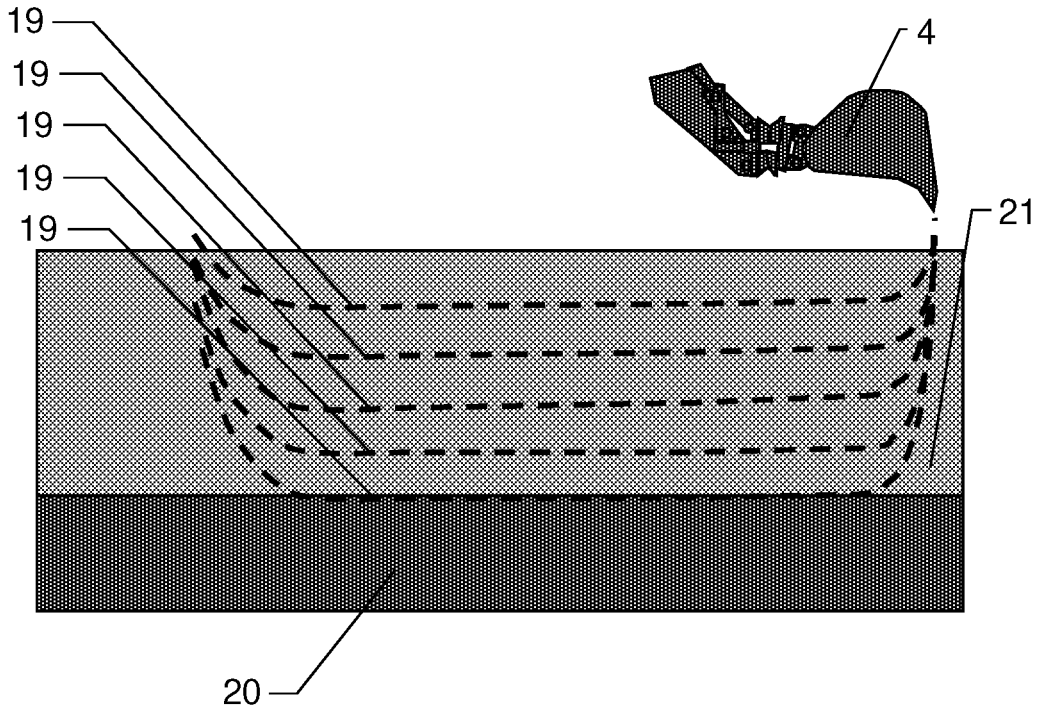
FIG. 2-9: schematic illustrations of use-cases for the method.

FIG. 2 shows a schematic illustration of a use-case for the method, wherein in this use case digging to successively greater depths 19 is performed parallel to a design surface 20 (i.e. the desired end-effector trajectory), also using force-feedback to detect and maintain the digging depth 19.

For this purpose, the step of providing the adapted control commands of the method includes evaluating the estimated value of the impact parameter with respect to a material interaction criterion, wherein the material interaction criterion provides a defined interaction mode of the contact-component with the material to be moved (dig material).

The bucket 4 is moved into the ground to be excavated (dig material) 21 until the estimated end-effector force 13 indicates that a desired digging depth 19 has been reached. Subsequently, a material interaction criterion is selected from the set of switchable material interaction criterions by selecting a defined interaction mode as soon as the desired digging depth 19 is reached. In this example, the defined interaction mode ensures that the bucket 4 is no longer moved vertically into the dig material 21 when the desired digging depth 19 is reached, but is merely moved horizontally (parallel to the design surface 20) in the direction of the excavator. In the next step, the bucket 4 is again moved vertically into the ground 21 at the start position until the desired digging depth 19 has been reached again. Then the defined interaction mode is selected again and the bucket 4 is again moved parallel to the design surface 20 in the direction of the excavator.

In this way, the method provides not only excavation at the desired digging depth 19 and parallel to the design surface 20, but also digging to successively greater depths 19 (getting deeper step by step, with the respective steps corresponding to the desired digging depth 19) parallel to the design surface 20.

Figure 3:
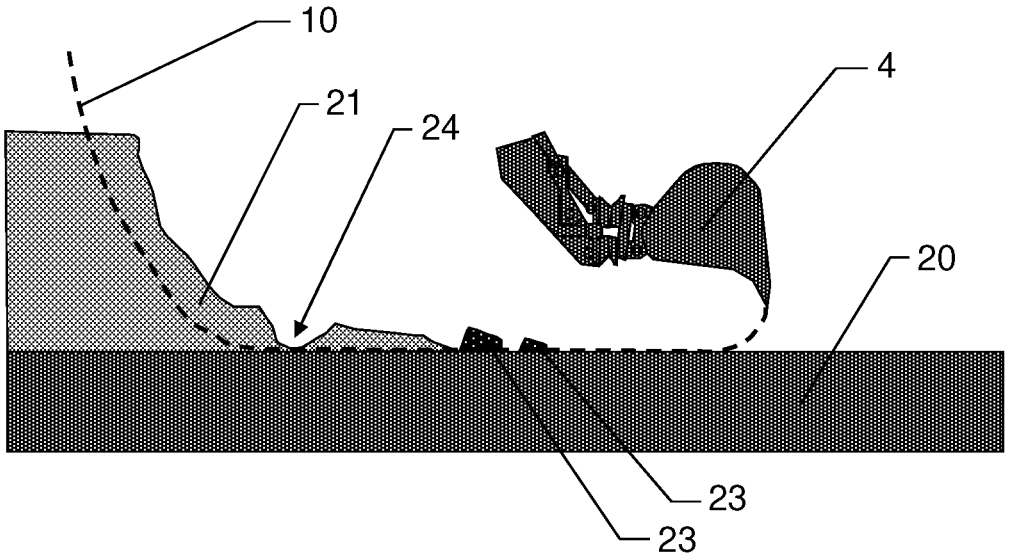

FIG. 3 shows a schematic illustration of a use-case for the method, wherein in this use case a straight-line motion (i.e. the desired end-effector trajectory 10) is maintained despite variations in the dig material 21. This is, for example, achieved by adapting the speed depending on the ground force, e.g. reducing it if the ground force is high in order to maintain accuracy.

The bucket 4 is moved with a straight-line motion through the dig material 21 to obtain the design surface 20, wherein by means of the material interaction criterion an interaction mode has been selected which, for example by controlling the cylinder pressures and/or varying the entry angle of the bucket 4 into the dig material 21, provides an end-effector force that enables an optimized excavation (e.g. time-efficient, fuel-saving, without shock/vibration of the operator, bucket sticking, etc.) of the dig material 21.

If the bucket 4 now hits the stones 23, which have a different density compared to the dig material 21, an increase in the estimated end-effector force is determined and a classification of the dig material is carried out by the computing unit 9 based on the determined estimated end-effector force. In order to remove the stones 23 and maintain a straight-line motion, another defined interaction mode is carried out (as a function of variations in the dig material), in which, for example by controlling the cylinder pressures and/or varying the entry angle of the bucket 4 (providing adapted control commands by using the movement model), an end-effector force is provided that is sufficiently high to be able to remove the stones 23. After the stones 23 have been removed, a defined interaction mode is selected again, which allows an optimized excavation of the dig material 21. If the bucket 4 encounters a hollow 24 during the execution of the straight-line motion, an abrupt decrease of the ground resistance takes place and thus a reduced estimated end-effector force is determined.

A classification of the dig material is again carried out by the computing unit 9 based on the determined estimated end-effector force, and again another defined interaction mode is carried out, in which, for example, a reduction of the digging speed is provided, in order to prevent shocks to the operator due to excessive acceleration of the bucket through the hollow 24 while ensuring straight-line motion.

Figure 4:
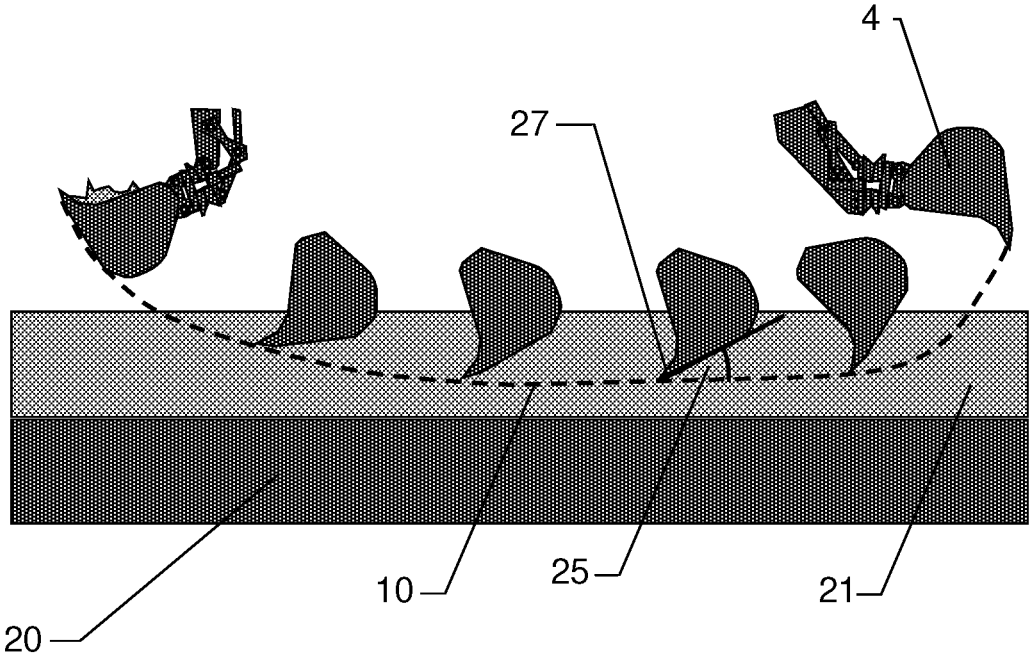

FIG. 4 shows a schematic illustration of a use-case for the method, wherein in this use case an optimal depth and/or bucket angle 25 and/or linear speed is achieved in order to maximize digging efficiency (in terms of speed and fuel consumption). For example, the bucket angle 25 is adjusted such that the dot product of force and velocity (that is power) is minimized. This efficiency information is then provided as feedback to the operator.

The bucket 4 is thereby moved onto the dig material 21 and an estimated end-effector force is determined, wherein based on the determined estimated end-effector force by means of the material interaction criterion, an interaction mode is selected, which, for example, adjusts the bucket 4 via the extension and retraction of the relevant cylinders such that the bucket angle 25 between the bucket teeth (contact component) 27 and the dig material 21 remains constant (for as long as possible) when the bucket 4 passes through the dig material 21 in accordance with the desired target trajectory 10 and, at this constant bucket angle 25, the end-effector force and/or load is minimal at a given end-effector velocity/speed, wherein a maximized digging efficiency (e.g., in terms of speed and fuel consumption) is achieved by using the method.

Figure 5:
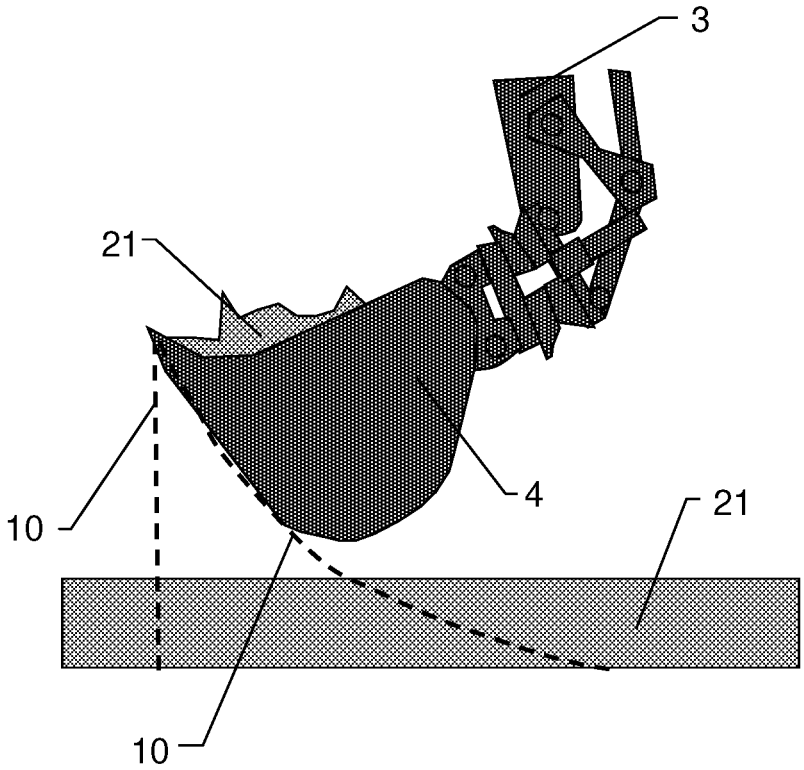

FIG. 5 shows a schematic illustration of a use-case for the method, wherein in this use case detecting/ensuring the full bucket capacity is utilized.

The bucket 4 is moved through or lifted out of the dig material 21, and based on the estimated end effector force, the computing unit 9 calculates the filling level and/or weight level of the bucket 4 depending on the dig material 21. The filling level and/or weight level of the bucket 4 is then taken into account by the material interaction criterion, wherein, once the filling level and/or weight level of the bucket 4 has reached a predefined value, in particular between 80% and 140%, a filling level and/or weight level notification (e.g., a haptic and/or visual (e.g., percentage of the filling level and/or weight level could be displayed as a number on a screen) and/or acoustic signal) is provided to the operator of the excavator, and/or adapted control commands are provided by using the movement model in order to exit the bucket 4 from the dig material 21 (ground) and/or release the dig material 21 from the bucket 4.

When the filled bucket 4 is lifted out of the dig material 21, for example, a camera attached to the bucket 4 or to the arm 3 records the filling level of the bucket 4 with the dig material 21 (camera data) and the computing unit 9 quantifies the filling level of the bucket 4 and/or classifies the dig material 21 in a next step based on the camera data. Then, the quantified filling level of the bucket 4 and/or the classified dig material 21 are matched with the filling level of the bucket 4 comprised by the material interaction criterion, wherein a more accurate determination of the filling level of the bucket 4 is achieved.

Figure 6:
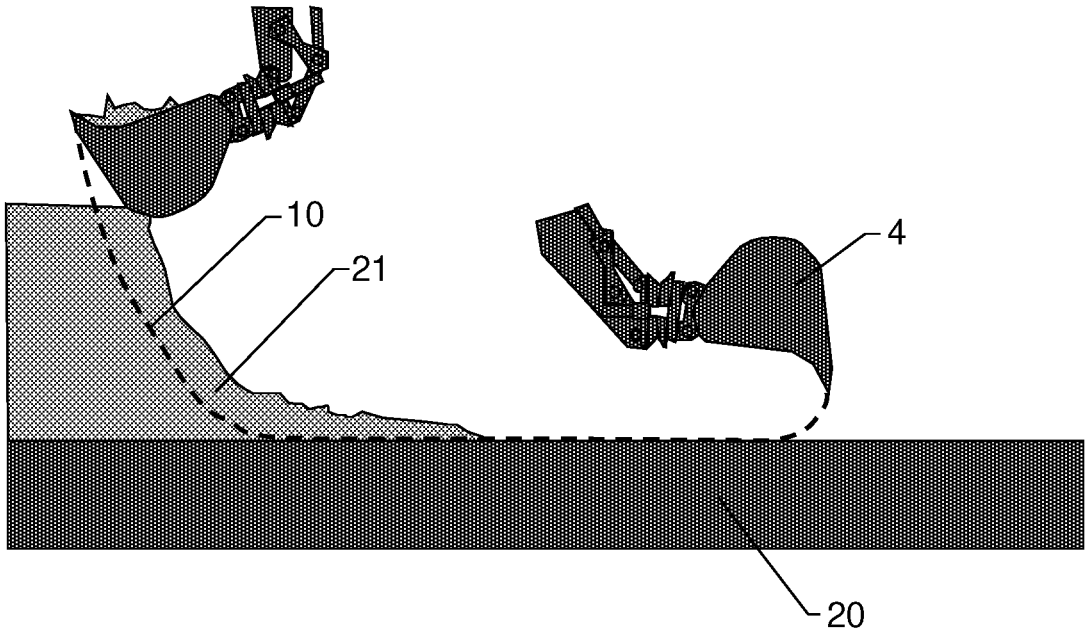

FIG. 6 shows a schematic illustration of a use-case for the method, wherein in this use case high material resistance is detected and an exit from the material is initiated.

The bucket 4 is moved along the design surface 20 (at this point it has already been excavated down to the design surface 20), resulting in a low resistance acting on the bucket 4 and thus determining a low estimated end-effector force. Based on this estimated end-effector force, an interaction mode is provided by means of the material interaction criterion, in which the design surface 20 is followed and the movement speed of the bucket 4 is reduced due to the low resistance.

When the bucket 4 then contacts the dig material 21, a higher resistance is present and thus a higher estimated end-effector force is determined. Based on this new estimated end-effector force, an interaction mode is provided by means of the material interaction criterion, in which the design surface 20 is no longer followed, but the bucket is raised (with increased movement speed) along the target trajectory 10 in order to fill the bucket and prevent stalling. If the bucket 4 is then lifted out of the dig material 21, the determined estimated end-effector force decreases rapidly and a change of the interaction mode is initiated by means of the material interaction criterion.

Figure 7:
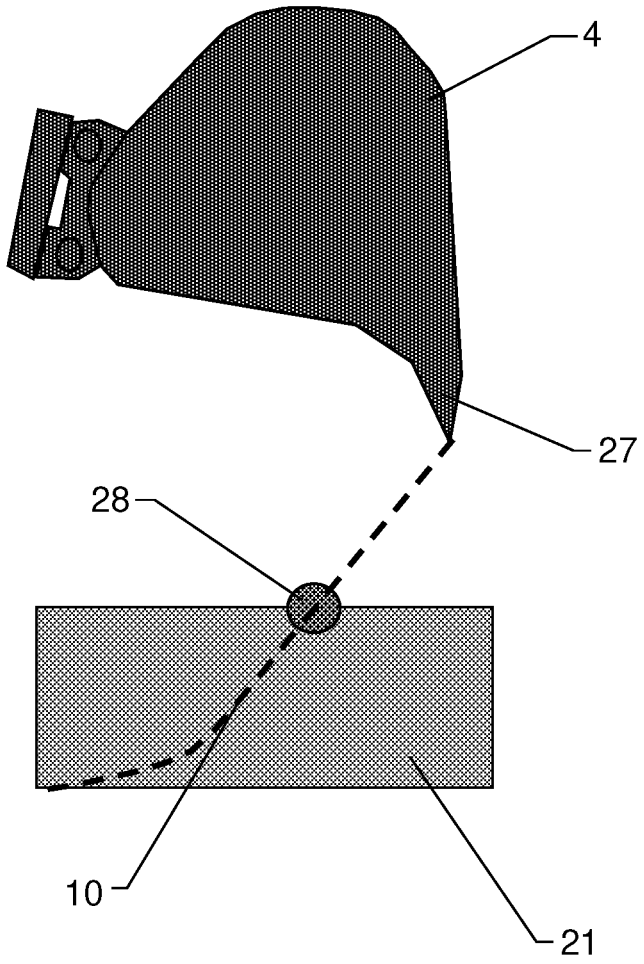

FIG. 7 shows a schematic illustration of a use-case for the method, wherein in this use-case the contact speed/force profile of the bucket 4 is adjusted to prevent shocks to the machine/operator (soft contact with the ground 21) while maximizing speed of penetration.

The bucket 4 is initially moved through the air (low resistance), which determines a low estimated end-effector force. At point 28, the teeth (contact component) of the bucket 4 hit the dig material 21 (higher resistance caused by impingement of the end-effector on the dig material 21), which leads to an abrupt increase in the estimated end-effector force. Based on the increase of the estimated end-effector force, an interaction mode is provided by means of the material interaction criterion, in which, for example, the movement speed of the bucket 4 is reduced or the force with which the bucket 4 is moved through the dig material 21 is increased, so that an abrupt movement (shock) of the excavator and/or the boom 2 and/or the arm 3 and/or the bucket 4 is prevented.

Such an interaction mode can also be provided, for example, when lifting the bucket 4 from the dig material 21.

Figure 8:
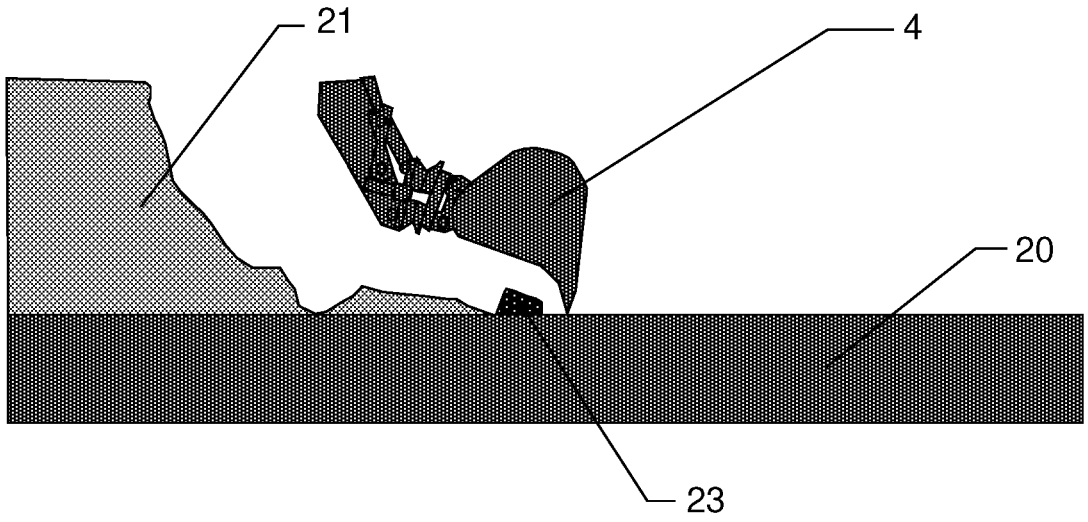

FIG. 8 shows a schematic illustration of a use-case for the method, wherein in this use case the motion of the bucket 4 is adapted based on the estimated end-effector force (resistance) (i.e. compliant (stiffness) control or stall protection).

The bucket 4 is moved along the design surface 20 (at this point it has already been excavated down to the design surface 20), resulting in a low resistance acting on the bucket 4 and thus determining a low estimated end-effector force. Based on this estimated end-effector force, an interaction mode is provided by means of the material interaction criterion, in which the design surface 20 is followed and the movement speed of the bucket 4 is reduced due to the low resistance.

If the bucket 4 then hits the stone 23, a particularly high resistance is present and thus a particularly high estimated end-effector force is determined. Based on this new estimated end-effector force, an interaction mode is provided by means of the material interaction criterion, in which the motion of the bucket 4 is rapidly adapted, i.e., for example, the speed of motion of the bucket 4 is significantly reduced, which allows the bucket 4 to bounce somewhat and shocks are reduced.

However, an interaction mode can also be provided in which the bucket 4, as soon as particularly high resistances (e.g. the rock 23) and consequently particularly high estimated end-effector forces are determined, is moved around the obstacle by adapted control commands and the obstacle is thus circumvented (stall protection).

Figure 9:
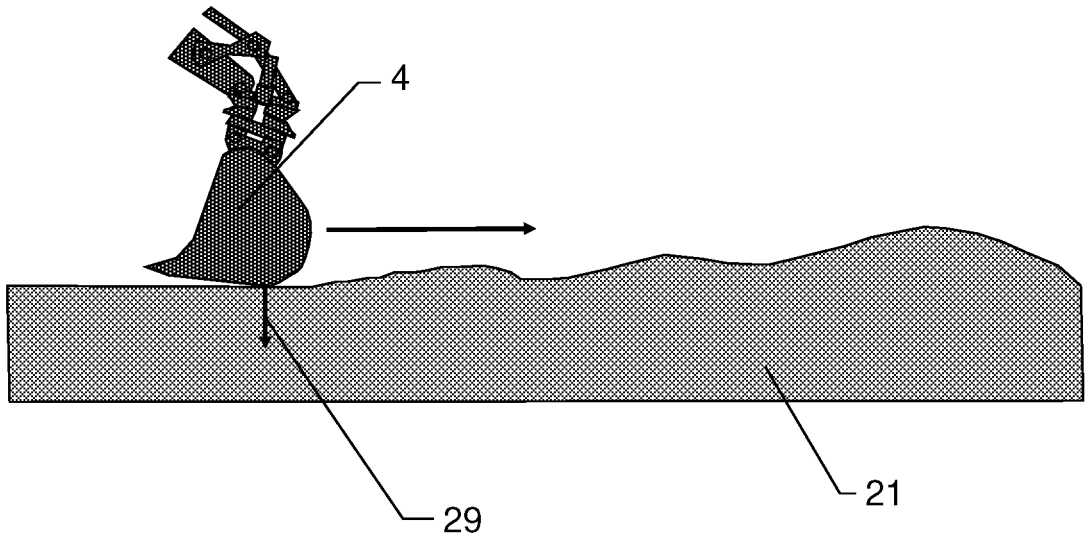

FIG. 9 shows a schematic illustration of a use-case for the method, wherein in this use case the vertical force 29 of the bucket 4 on the ground (dig material/material to be moved) 21 is controlled in order to compact the ground 21 with the back of the bucket 4.

The bucket 4 is oriented so that the back of the bucket presses on the ground 21 and the bucket 4 is then pushed horizontally across the ground 21 in this position (i.e. providing motion commands for moving the end-effector), to provide a flat surface (i.e., target trajectory associated with the motion commands). During this motion, the estimated end effector force is determined.

Based on this estimated end effector force, an interaction mode is provided using the material interaction criterion in which the vertical force is held constant while the back of the bucket 4 is moved horizontally over the ground 21.

Although the use cases of the method described in FIGS. 2-9 were performed using an exemplary method/system that uses movement sensor data and the impact sensor data to determine the estimated value of the impact parameter as an estimated end-effector force 13 (e.g., a 2D or 3D end effector force vector), is clear to the skilled person that the method/system can also be implemented if the estimated value of the impact parameter is determined as a load (e.g. a torque vector) exerted on one of the boom 2, the arm 3 or the bucket 4.

Although aspects are illustrated above, partly with reference to some preferred embodiments, it must be understood that numerous modifications and combinations of different features of the embodiments can be made. All of these modifications lie within the scope of the appended claims.

The invention claimed is:

1. A method for controlling movement of an end-effector of an excavator, wherein the end-effector is attached to the excavator via an articulated component comprising multiple links, wherein the method comprises:

providing motion commands for moving the end-effector, using a motion-control algorithm to translate the motion commands to control commands for moving the multiple links with respect to each other so that the end-effector moves with a target trajectory associated with the motion commands, by taking into account hydraulic response to resistance against the articulated component, and by taking into account spool shift in a hydraulic valve, accessing movement sensor data configured to provide monitoring of a movement of the articulated component and the end-effector, accessing impact sensor data comprising hydraulic pressure sensing data, which provide information on pressure applied to a hydraulic unit being configured to provide movement of the articulated component and/or the end-effector, and/or force sensor data, which provide a force and/or a moment measured at one of the multiple links and/or at the end-effector, using the movement sensor data and the impact sensor data to determine an estimated value of an impact parameter for the articulated component, wherein the impact parameter provides information on an end-effector force exerted by a contact-component of the end-effector specifically foreseen for interaction with material to be moved by the end-effector and/or information on a load exerted on one of the multiple links, and providing adapted control commands by using a movement model for the articulated component configured to provide coordination of the control commands of the multiple links as a function of the estimated value of the impact parameter, wherein the providing of the adapted control commands comprises evaluating the estimated value of the impact parameter with respect to a material interaction criterion, wherein the material interaction criterion provides a defined interaction mode of the contact-component with the material to be moved, wherein the defined interaction mode provides a boundary on allowed values of the impact parameter.

2. The method according to claim 1, wherein the evaluating comprises selecting the material interaction criterion from at least two different material interaction criterions which define different boundaries on the allowed values of the impact parameter.

3. A computer program product comprising program code which is stored on a non-transitory machine-readable medium, wherein the program code comprises computer-executable instructions for performing the steps in the method according to claim 2.

4. The method according to claim 1, wherein:

the articulated component is configured as an excavator arm, the multiple links are configured as a boom, a stick, and a tilt-rotor, the hydraulic valve and/or the hydraulic unit is configured as a cylinder, and/or the contact-component of the end-effector is configured as a blade, a tooth, and/or a back of a bucket, and wherein the end-effector is configured as a bucket, wherein the multiple links are movably connected to each other and/or the end effector is movably connected to at least one of the multiple links by means of joints.

5. The method according to claim 4, wherein the movement model is configured to provide a relationship between valve commands, determined cylinder forces, and determined joint velocities to estimate their impact on the end-effector force and/or the load.

6. The method according to claim 1, further comprising generating a history of data providing comparison information between the hydraulic pressure sensing data being obtained from the hydraulic unit and/or providing comparison information between the force sensor data being obtained from the end-effector performing motions in air and in the material, wherein the movement model is configured to be trained using a learning algorithm, using supervised learning, and using the history of data, and wherein the movement model is configured to be trained in a simulation environment.

7. The method according to claim 1, further comprising training the motion-control algorithm by reinforcement learning such that the motion-control algorithm learns:

to translate the motion commands to the control commands for moving the multiple links with respect to each other so that the end-effector moves with the target trajectory, and/or to provide the material interaction criterion dependent on the end-effector force.

8. The method according to claim 1, wherein the material interaction criterion is selected from a set of switchable material interaction criterions defining different interaction modes, wherein the switching between the material interaction criterions is performed automatically based on:

a design surface, wherein the design surface is derived from previous target trajectories, and/or a history of previous end-effector forces and/or loads, wherein from the previous end-effector forces and/or loads a material property is derived and assigned to an interaction mode, wherein based on the assignment of the material property to an interaction mode the associated material interaction criterion is selected.

9. The method according to claim 1, wherein the movement sensor data and/or the impact sensor data are accessed during at least one of:

digging, pulling the end-effector, in particular the contact-component, over the ground, lifting the end-effector filled with material, moving the end-effector through the air, pressing with the end-effector with the contact-component on the ground.

10. The method according to claim 1, wherein the material interaction criterion is configured to take into account a desired ground resistance, wherein the material interaction criterion ensures that a coordination of control commands is provided to ensure the end-effector force provides a ground resistance below the desired ground resistance.

11. The method according to claim 1, wherein the material interaction criterion provides selection between different interaction modes as a function of variations in the material in density and/or cohesion, wherein variations in the material are used to classify the material, wherein the defined interaction mode is carried out dependent on the material.

12. The method according to claim 1, wherein the material interaction criterion controls an impingement of the end-effector on and/or a lifting of the end-effector from the material to be moved by the end-effector, wherein the defined interaction mode is carried out in such a way that an abrupt movement of the excavator and/or the articulated component and/or the end-effector is prevented.

13. A computer program product comprising program code which is stored on a non-transitory machine-readable medium, wherein the program code comprises computer-executable instructions for performing the steps in the method according to claim 12.

14. A system for controlling an excavation operation by the end effector of the excavator, wherein the system is configured to carry out the method of claim 1, and comprises a computing unit configured:

to receive the motion commands of the step of providing the motion commands, to use the motion-control algorithm of the step of using the motion-control algorithm to translate the motion commands to the control commands, wherein the motion-control algorithm is stored on the computing unit, to access the movement sensor data of the step of accessing the movement sensor data, to access the impact sensor data of the step of accessing the impact sensor data, to use the movement sensor data and the impact sensor data of the step of using the movement sensor data and the impact sensor data to determine the estimated value of the impact parameter for the articulated component, and to provide adapted control commands of the step of providing the adapted control commands by using the movement model for the articulated component, wherein the movement model is stored on the computing unit.

15. The system according to claim 14, further comprising a sensor unit configured to be mounted on the excavator and, and when mounted to the excavator, to provide the movement sensor data, wherein the sensor unit is configured as a pressure sensor determining pressure data of the cylinder.

16. A computer program product comprising program code which is stored on a non-transitory machine-readable medium, and has computer-executable instructions for performing, when run on the computing unit of the system according to claim 14:

accessing the motion commands of the step of providing the motion commands, using the motion-control algorithm of the step of using the motion-control algorithm to translate the motion commands to the control commands, accessing the movement sensor data of the step of accessing the movement sensor data, accessing the impact sensor data of the step of accessing the impact sensor data, using the movement sensor data and the impact sensor data of the step of using the movement sensor data and the impact sensor data to determine the estimated value of the impact parameter for the articulated component, and providing the adapted control commands of the step of providing adapted control commands by using the movement model for the articulated component.

17. A computer program product comprising program code which is stored on a non-transitory machine-readable medium, wherein the program code comprises computer-executable instructions for performing the steps in the method according to claim 1.

* * * * *